US010166553B2

(12) United States Patent
Zhu

(10) Patent No.: US 10,166,553 B2
(45) Date of Patent: Jan. 1, 2019

(54) DIVERTER VALVE ASSEMBLY

(71) Applicant: Xiamen Lota International Co., Ltd., Xiamen (CN)

(72) Inventor: Chuanbao Zhu, Xiamen (CN)

(73) Assignee: Xiamen Lota International., Ltd. (CN)

( * ) Notice: Subject to any disclaimer, the term of this patent is extended or adjusted under 35 U.S.C. 154(b) by 0 days.

(21) Appl. No.: 15/493,515

(22) Filed: Apr. 21, 2017

(65) Prior Publication Data

US 2018/0304279 A1 Oct. 25, 2018

(51) Int. Cl.
*B05B 1/16* (2006.01)

(52) U.S. Cl.
CPC ..... *B05B 1/1636* (2013.01)

(58) Field of Classification Search
CPC ..... B05B 1/1636; B05B 1/18; B05B 1/1627; E03C 1/025; E03C 1/02; E03C 1/0408
USPC ..... 239/273, 447
See application file for complete search history.

(56) References Cited

U.S. PATENT DOCUMENTS 3,687,416 A * 8/1972 Mueller ..... F16K 5/0278 251/164
4,145,004 A 3/1979 Krizik
4,274,400 A * 6/1981 Baus ..... A47K 3/28 601/169
4,754,928 A 7/1988 Rogers et al.
5,090,624 A 2/1992 Rogers
5,093,943 A 3/1992 Wei
5,558,278 A 9/1996 Gallorini
5,678,258 A * 10/1997 Healy ..... A47K 3/28 4/601
5,901,387 A 5/1999 Fan
6,038,715 A * 3/2000 Flieger ..... A47K 3/283 4/601
6,412,710 B1 7/2002 Lin et al.
6,557,770 B2 5/2003 Mace et al.
6,854,658 B1 2/2005 Houghton et al.
6,959,731 B2 11/2005 Bartkus et al.
7,080,790 B2 7/2006 Lorch
7,114,515 B2 10/2006 Sponheimer et al.
(Continued)

FOREIGN PATENT DOCUMENTS

CN 206290761 U 6/2017
EP 1167641 * 1/2002 ..... E03C 1/06
EP 1 293 712 A2 3/2003

OTHER PUBLICATIONS

Heimann et al., English translation of EP1167641, Holder for a hand-held shower head, Jan. 2002.*

*Primary Examiner* — Chee-Chong Lee
(74) *Attorney, Agent, or Firm* — Barnes and Thornburg LLP

(57) ABSTRACT

The invention provides a diverter valve assembly for use with multiple water discharge fixtures, such as a shower head and a hand-held sprayer. The diverter valve assembly includes a valve body having an inlet port and multiple outlet ports, a rotatable valve core and a rotation knob. Rotational positioning of an elastic cup seal on the valve core blocks water flow at any of the inlet port and the outlet ports, allowing water flow from a single water source to one of the water discharge fixtures at a time, or to both of the water discharge fixtures simultaneously. The diverter valve assembly also includes a holder for storing the hand-held sprayer.

20 Claims, 7 Drawing Sheets

(56) References Cited

U.S. PATENT DOCUMENTS

| | | | | |
|---|---|---|---|---|
| 7,219,376 | B1 * | 5/2007 | Zhou | E03C 1/06 239/280.5 |
| 7,229,510 | B2 | 11/2007 | Tsai | |
| 7,303,151 | B2 | 12/2007 | Wu | |
| 7,762,479 | B2 | 7/2010 | Li | |
| 9,151,025 | B2 | 10/2015 | Zhu et al. | |
| 2006/0016001 | A1 | 1/2006 | Zhao | |
| 2006/0060678 | A1 | 3/2006 | Mazzola | |

* cited by examiner

DIVERTER VALVE ASSEMBLY

TECHNICAL FIELD

The invention relates to a diverter valve assembly that is installed in a water discharging fixture, such as a faucet or shower head. The diverter valve assembly includes an inlet port, first and second outlet ports, and a valve assembly for controlling fluid flow to the first and second outlet ports.

BACKGROUND OF THE INVENTION

Diverter assemblies are known, and can be found in both residential and commercial settings. In either setting, the diverter assembly provides selection and control of fluid flow from a water source (e.g., a shower water pipe) to one or more water outlets. Such water outlets may include a fixed shower head or a flexible hand-held sprayer. A rotatable knob on the diverter assembly allows a user to change the flow of the water, such that the water is directed to either the shower head or to the hand-held sprayer. Typically, the body of the diverter assembly may include a holder or slot for retaining the hand-held sprayer in a fixed position when that sprayer is not being used.

The diverter assembly may also include a spring in the valve that controls the direction of water flow from the water inlet to the water outlets. Minerals in the water, such as calcium (Ca) and magnesium (Mg), may accumulate on the spring over time. Such accumulations can corrode and adversely affect the life span of the spring and the diverter assembly.

The present invention is intended to solve the limitations of conventional diverter valve assemblies discussed above. The present invention is also intended to solve other problems inherent in, and to provide advantages and aspects not provided by, prior diverter valve assemblies. Some of the features and advantages of the present invention are described in the following detailed description and the accompanying drawings.

SUMMARY OF THE INVENTION

The present invention is directed to a fluid delivery assembly that includes a number of components that collectively define a fluid flow path. The fluid flow path includes a fluid source (such as a hot and cold water source) and a fluid discharge assembly (such as a faucet). These components may include a tube assembly (e.g., a plastic tube assembly), a housing (e.g., a cartridge housing), and a retaining assembly (e.g., a threaded mounting shank and a cooperatively threaded mounting nut). The structure of these components enable the fluid delivery assembly to be easily attached to, or detached from, a faucet assembly by hand, without the use of tools. These components may be separate and distinct. In this way, an individual component may be removed and replaced.

An important feature of the fluid delivery assembly of the invention is that it may be mounted completely below its related countertop or deck. Thus, the installation or removal of the fluid delivery assembly occurs completely below the countertop or deck. This permits installation or removal of the fluid delivery assembly without removing or replacing the portions of the corresponding faucet assembly that are positioned above the deck.

According to one aspect of the invention, the fluid delivery assembly includes a tube assembly having a plurality of tubes; a housing configured to receive a fluid flow cartridge assembly; and a retaining assembly.

The tube assembly may be formed of any suitable material, including but not limited to PERT. The tube assembly may include two tubes. The first tube provides a water pathway from a water source line to the cartridge housing. The second tube provides a water pathway from the cartridge housing to a water discharge assembly, such as a faucet. Alternatively, the first tube may provide hot water from the hot water source line to the cartridge housing, and the second tube may provide cold water from the cold water source line to the cartridge housing.

An end portion of the first tube may be sized and/or shaped differently than an end portion of the second tube. The related housing may have two mating cavities, each sized and shaped to receive the complementarily sized and shaped end portions of the respective first and second tubes. As a consequence of this construction, the tube assembly may only be inserted into the housing in one particular orientation.

The retaining assembly includes a securing member that has a threaded portion. The securing member is (a) movable upwardly and downwardly along a portion of the length of the tube assembly; and (b) rotationally movable around the circumference of the tube assembly.

The retaining assembly also includes a mounting member that has a threaded portion.

As the securing member is rotated by hand, the threaded portion of the securing member and the threaded portion of the mounting member cooperatively engage with each other to secure the tube assembly to the housing.

The securing member and the mounting member include sufficient threading to ensure a precise and well-sealed connection between the tube assembly and an end body. Preferably, the securing member is externally threaded and the end body is internally threaded. Alternatively, the securing member may be internally threaded and the end body may be externally threaded.

The housing, the tube assembly and the retaining assembly are separate components that are not integrally formed together, such as by over-molding or adhesively bonding. Therefore, any component may be removed and/or replaced while keeping the other components as part of the faucet assembly.

Other features and advantages of the aspects of the invention will be apparent from the following specification, taken in conjunction with the accompanying drawings.

DETAILED DESCRIPTION

This invention may take many different forms. The current description and drawings teach only a few of the many different forms or embodiments of the invention. It should be understood that the present disclosure is to be considered as disclosing only a few, non-limiting examples of the principles of the invention. This disclosure is not intended to limit the broadest aspects of the invention to the illustrated embodiments.

Figure 1:
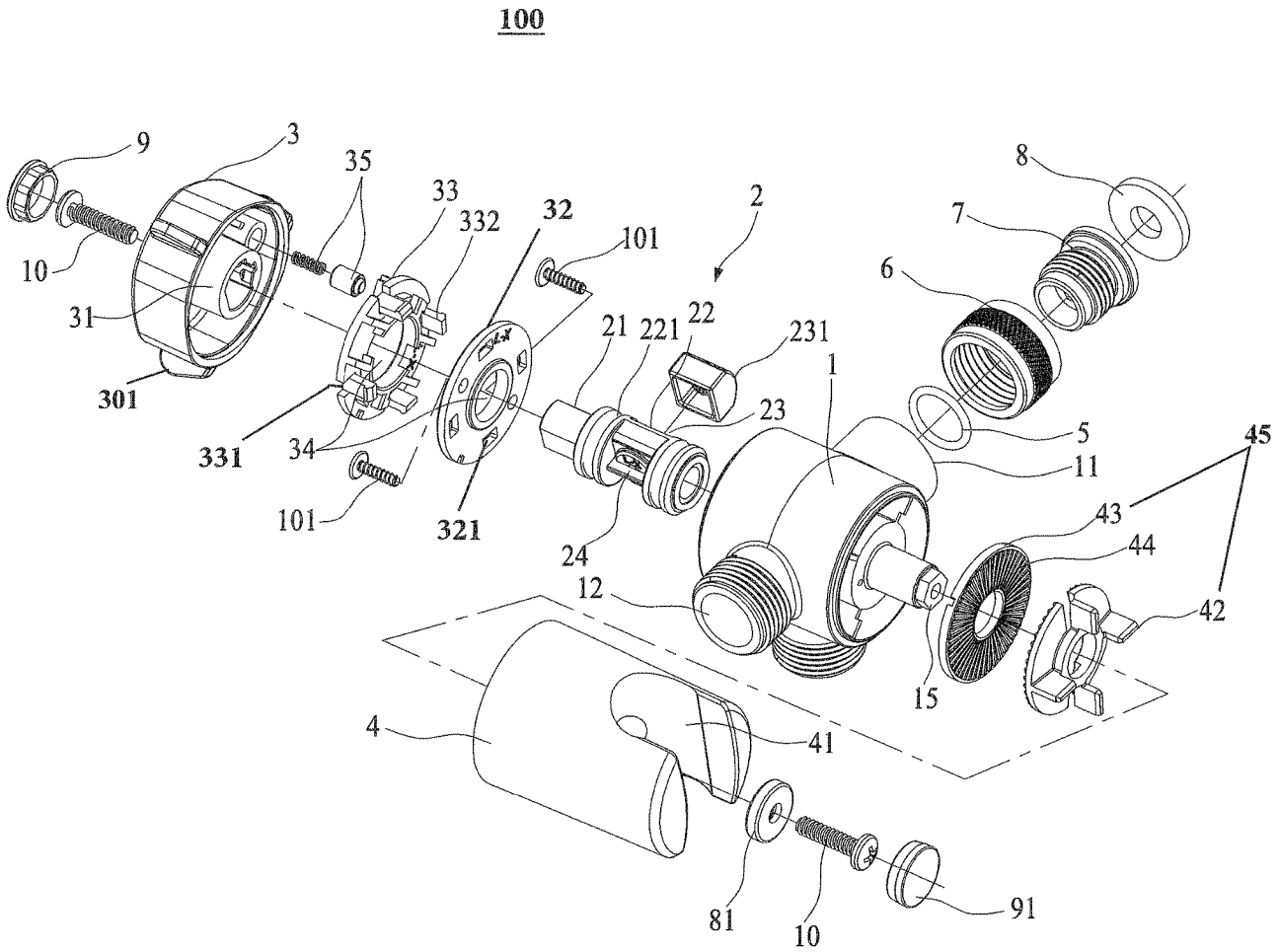
FIG. 1 is an exploded perspective view of an embodiment of a diverter valve assembly.
Figure 2:
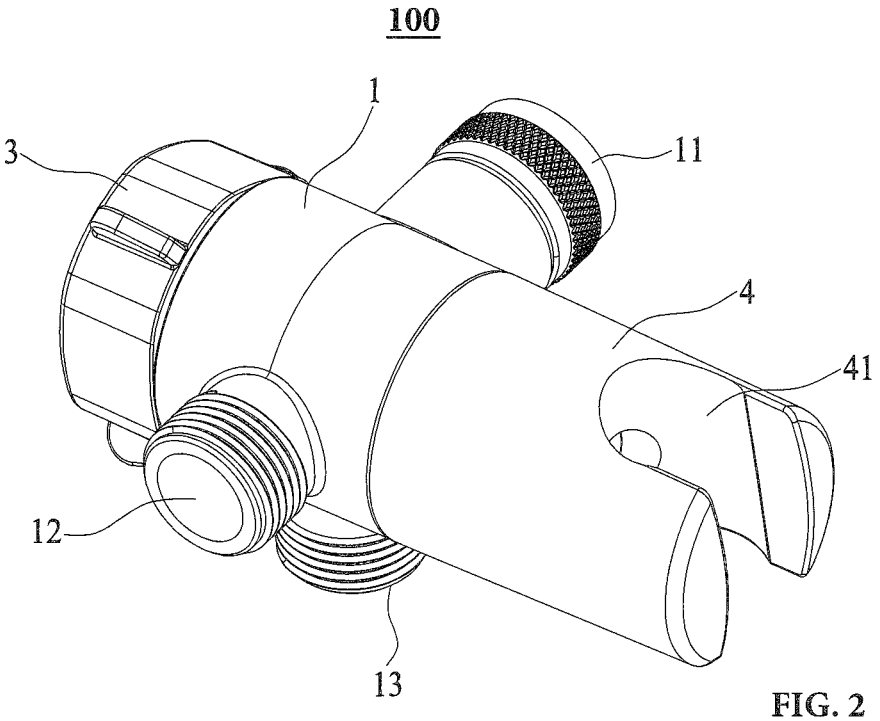
FIG. 2 is a perspective view of the diverter valve assembly of FIG. 1, but in an assembled state.

Referring to FIGS. 1 and 2, a diverter valve assembly 100 includes a valve body 1. The valve body 1 includes an inlet port 11, a first outlet port 12 and a second outlet port 13. A holder 4 is coupled to a first side of the valve body 1.

Referring now to FIG. 1, the valve body 1 contains a valve core 2. Valve core 2 facilitates the flow of water through the valve body 1. As may be seen in FIG. 3, a rotation knob 3 is coupled to one end of the valve core 2.

As may best be seen in FIGS. 2 and 4-7, the first outlet port 12 and the second outlet port 13 of the valve body 1 may include external threads. FIG. 8 depicts how these outlet ports 12 and 13 may be connected to a showerhead 90 or a hand-held sprayer 92, respectively, of a water dispensing device. FIG. 8 also shows that the inlet port 11 is connected to a water supply pipe or hose 94.

Referring back to FIG. 1, various components facilitate the connection of the inlet port 11 to the water supply pipe or hose 94. These components include an o-ring 5, a connector nut 6, a retainer 7, and a washer 8.

FIGS. 4-7 show an internal chamber 14 contained within the valve body 1. This internal chamber 14 is in fluid communication with the inlet port 11, the first outlet port 12, and the second outlet port 13.

As may best be seen in FIG. 1, the valve body 1 includes two open sides. The open left side of the valve body 1 receives the valve core 2. The open right side of the valve body 1 houses a protruding column 15.

Figure 3:
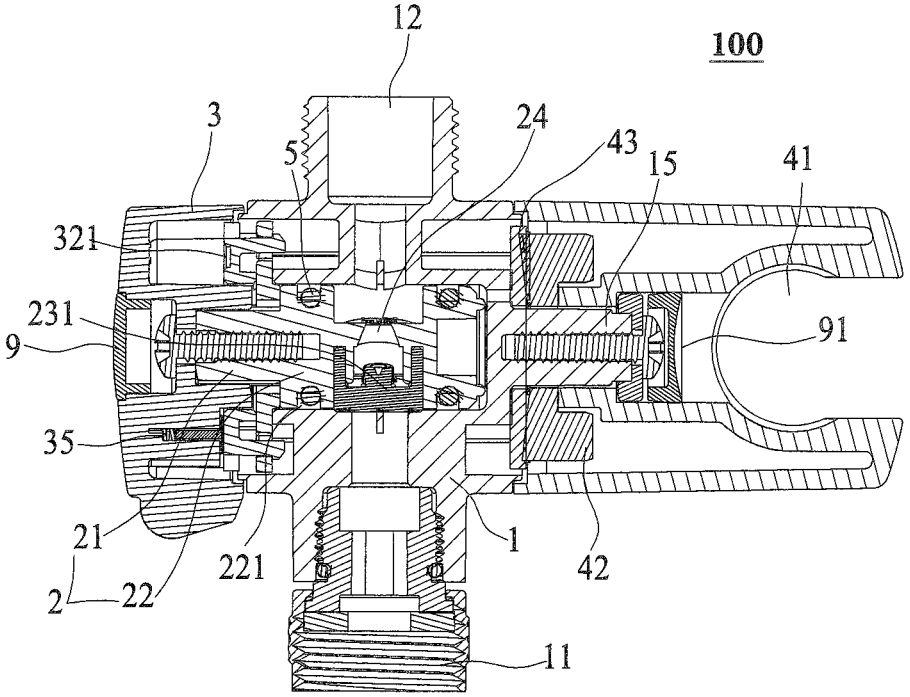
FIG. 3 is a cross-sectional front view of the diverter valve assembly of FIG. 2.

FIG. 3 shows the valve core 2 positioned within the chamber 14. The valve core 2 is designed and configured to fit hermetically within that chamber 14. As may best be seen in FIGS. 1 and 3, the valve core 2 is an integrated structure comprising a valve stem 21 and a center plug 22.

Referring to FIGS. 1 and 3, the end portions of the center plug 22 include multiple circumferential grooves 221. Two such grooves 221 are shown in the embodiment of FIGS. 1 and 3. Each circumferential groove 221 receives an o-ring 5 to minimize or prevent the leakage of water from chamber 14.

As may best be seen in FIG. 1, a central portion of the center plug 22 includes a partition 23 and a passage 24. An elastic cup seal 231 is coupled to the partition 23. The elastic cup seal 231 forms a convex surface. That surface defines an area that is larger than the opening for any of the inlet port 11, the first outlet port 12, or the second outlet port 13. As a result, as shown in FIGS. 4-6, when positioned adjacent either the inlet port 11, the first outlet port 12, or the second outlet port 13, the elastic cup seal 231 will completely plug and block fluid flow to or from any of those ports.

This ability to plug and block fluid flow is shown in each of FIGS. 4-7. The rotation of the valve core 2 by the user causes the corresponding rotation of the attached elastic cup seal 231. The rotation of the elastic cup seal 231 facilitates the plugging of the inlet port 11, the first outlet port 12, the second outlet port 13, or none of these ports.

Figure 4:
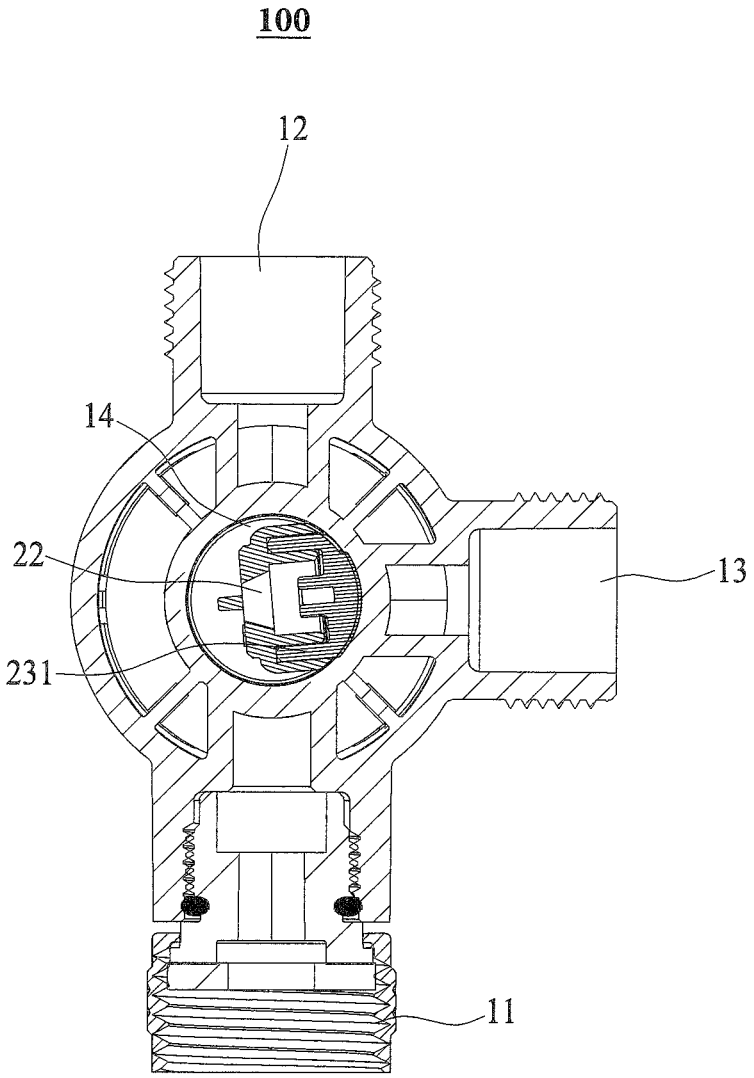
FIG. 4 is a cross-sectional side view of the diverter valve assembly of FIG. 2, with its internal parts positioned to permit open fluid flow from an inlet to a first outlet port.

For example, in FIG. 4 the elastic cup seal 231 plugs the second outlet port 13, allowing water to flow into the chamber 14 from the inlet port 11, and out of the chamber 14 through the first outlet port 12.

Figure 5:
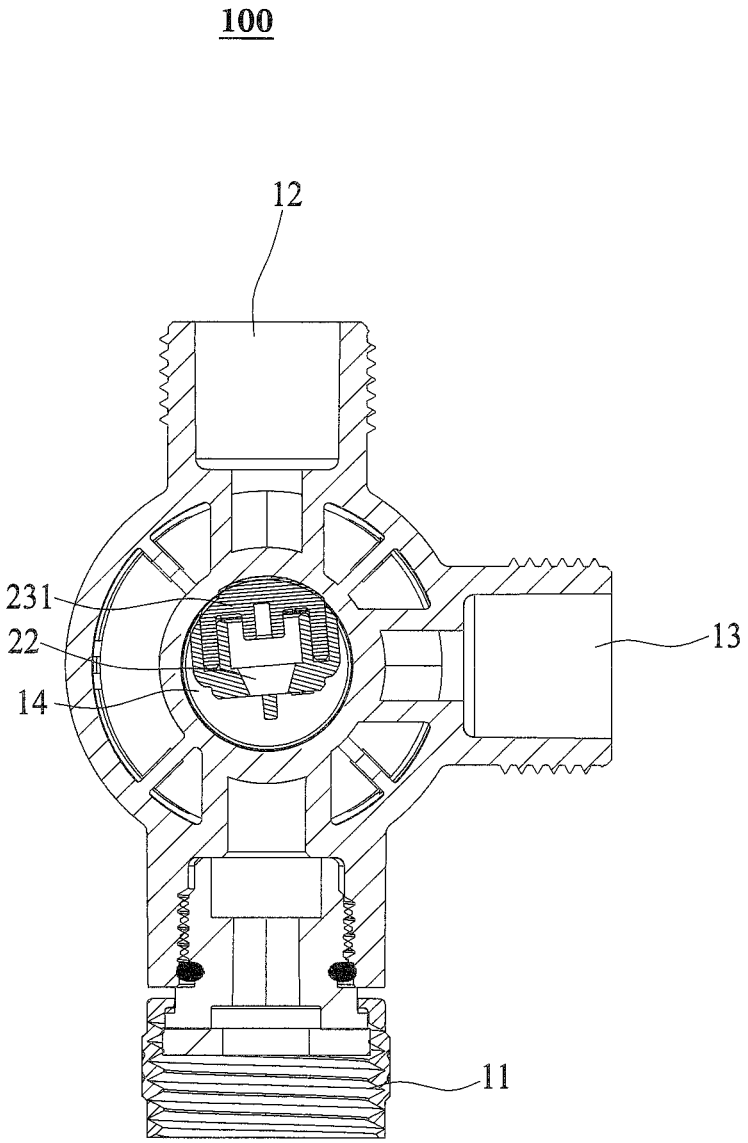
FIG. 5 is a cross-sectional side view of the diverter valve assembly of FIG. 2, with its internal parts positioned to permit open fluid flow from the inlet to a second outlet port.
Figure 6:
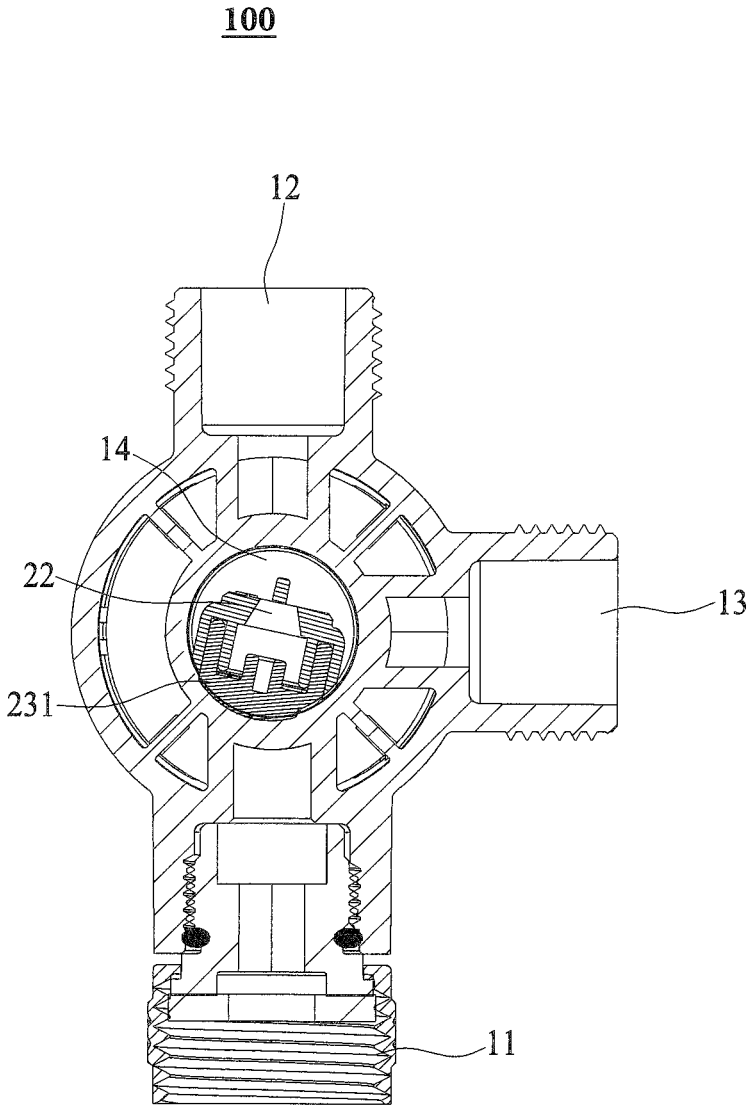
FIG. 6 is a cross-sectional side view of the diverter valve assembly of FIG. 2, but with its internal parts positioned to stop fluid flow through the inlet.

In FIG. 5, the elastic cup seal 231 plugs the first outlet port 12, allowing water to flow into the chamber 14 through the inlet port 11, and out of the chamber through the second outlet port 13.

In FIG. 6, the elastic cup seal 231 plugs the inlet port 11. Thus, no water can flow into the chamber 14 from the inlet port. When the elastic cup seal 231 is in this position, water cannot flow to either the first outlet port 12 or the second outlet port 13.

Figure 7:
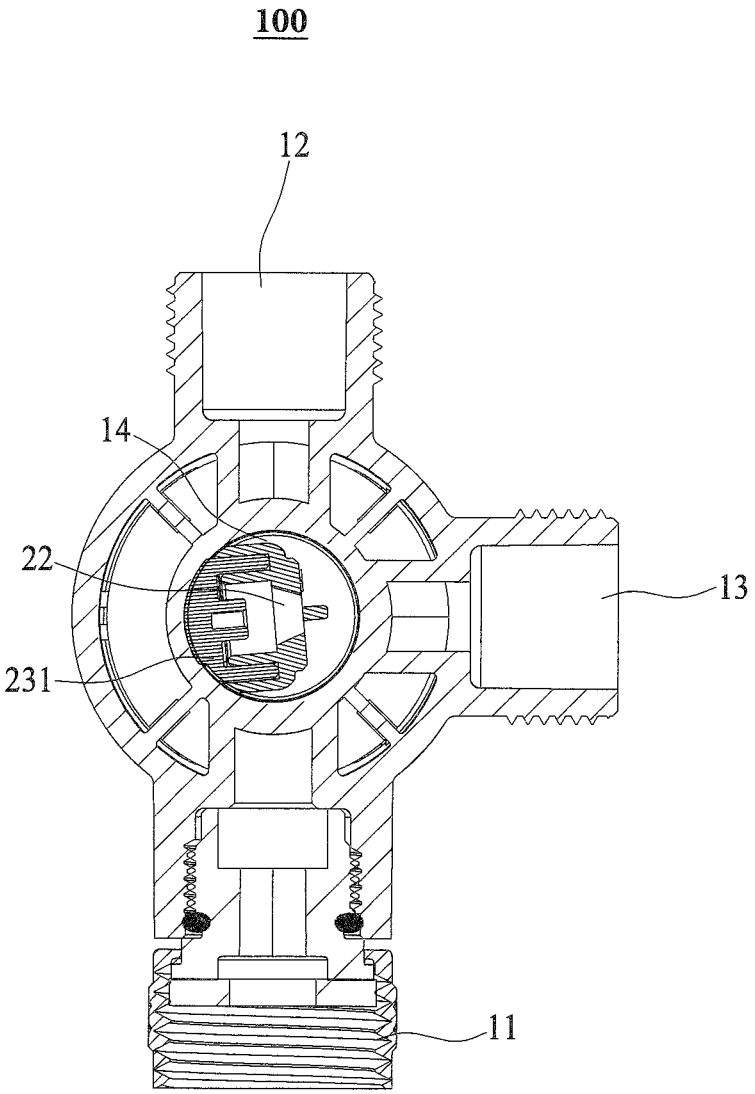
FIG. 7 is a cross-sectional side view of the diverter valve assembly of FIG. 2, with its internal parts positioned to permit fluid flow from the inlet to both the first and the second outlets.
Figure 8:
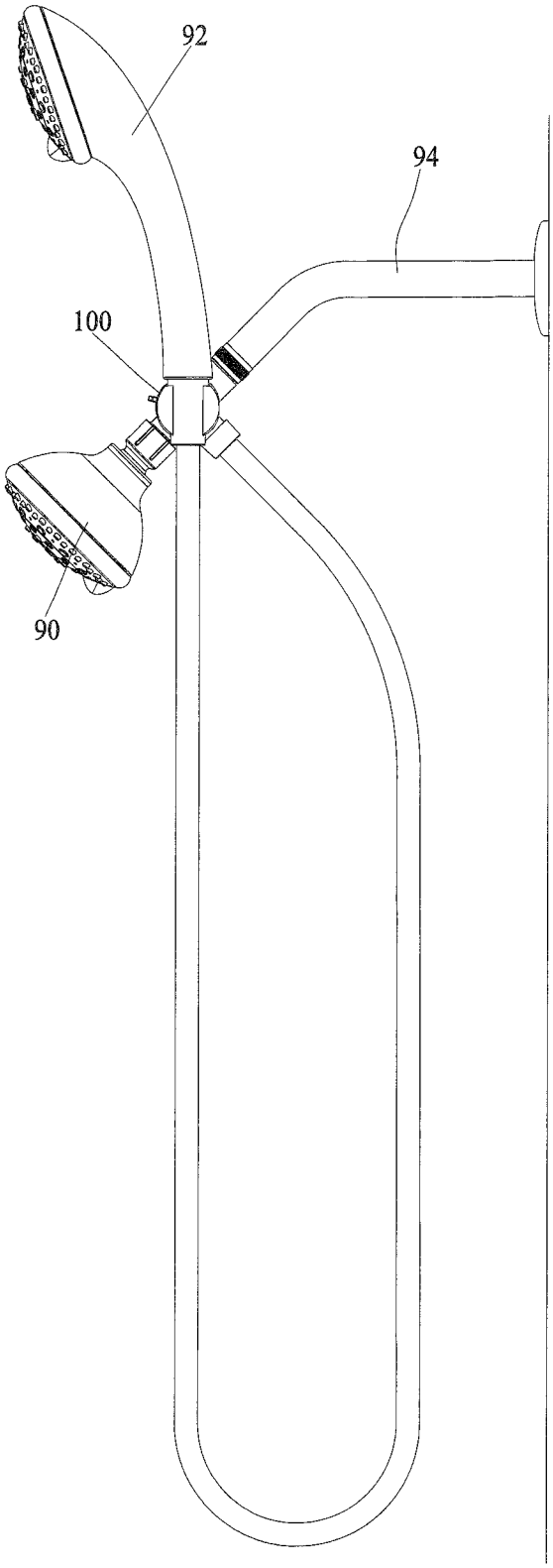
FIG. 8 is a side view of an embodiment of a shower assembly having a diverter valve assembly in accordance with the invention.

Finally, in FIG. 7 the cup seal 231 is positioned away from inlet port 11, the first outlet port 12, and the second outlet port 13. As a result, water will flow into the chamber 14 through the inlet port 11, and out of the chamber 14 and simultaneously through both the first outlet port 12 and the second outlet port 13.

As discussed above, the invention may include a rotation knob 3. The structure and operation of the rotation knob 3 may best be seen in FIGS. 1, 2, and 3. The rotation knob 3 may include an antiskid stripe 301. As may be seen in FIGS. 1 and 2, the rotation knob 3 may be attached to the valve stem 21 by a screw 10.

Referring now to FIG. 1, the rotation knob 3 has a cylinder that includes a slot 31 shaped to capture valve stem 21.

FIG. 1 also depicts an adjuster 32. That adjuster 32 is positioned between the valve core 2 and the cylinder having the slot 31. The adjuster 32 is attached to the valve body 1 by two screws 101. As these screws 101 are turned, they bring the adjuster 32 and the center plug 22 either closer to each other, or farther away from each other.

FIG. 1 also shows a positioner 33. This positioner 33 is configured to connect with the adjuster 32. For example, hooked spurs 332 extending from the positioner 33 may engage or connect with corresponding holes 321 on the adjuster 32.

A hole 34 is formed in the middle of each of the adjuster 32 and the positioner 33. The respective holes 34 permit the passage of the valve stem 21 through the adjuster 32 and the positioner 33. This in turn permits the valve stem 21 to be gripped by the rotation knob 3, and the valve core 2 to be rotated about its axis, when the user rotates the rotation knob 3.

As may also be seen in FIG. 1, the rotation knob 3 includes a spring plunger 35, which selectively engages with positioning slots 331 on the positioner 33. With the positioner 33, the rotation knob 3 turns the valve core 2 to any of the several positions of FIGS. 4-7. In this way, the elastic cup seal 231 plugs the desired portion of the valve body 1, and permits water flow only into a desired outlet port, with no leaking into undesired outlet ports.

In addition, water flowing through a fluid flow path or waterway will pressure the backside of the cup seal 231. As a result, the cup seal 231 will be pressured as well, and the sealing force of the cup seal 231 may be enhanced.

Referring to FIGS. 1-3 and 8, the holder 4 may have a U-shaped slot 41 for attaching the hand-held sprayer 92. As may be seen in FIG. 1, a washer 81 and screw 10 directly attach the holder 4 to the protruding column 15 on the right side opening of the valve body 1.

FIG. 1 also depicts a positioning device 45 that is disposed between the holder 4 and the valve body 1. The positioning device 45 rotates and secures the holder 4 into a desired position relative to the valve body 1. The positioning device 45 includes a top mesh plate 42 attached to the holder 4, and a bottom mesh plate 43 attached to the first side of the valve body 1. Matching surfaces of the top mesh plate 42 and the bottom mesh plate 43 face each other. These matching faces may be radial grooves 44 configured to engage each other. For example, a peak of each radial groove 44 on the top mesh plate 42 may engage with a valley of each corresponding radial groove 44 on the bottom mesh plate 43, and vice versa. The corresponding radial grooves 44 provide a frictional engagement. However, if enough rotational force is applied to overcome the frictional engagement of the radial grooves, the top and bottom mesh plates 42, 43 will rotate relative to each other.

Optionally, the faces of the mesh plates could include convex grains and grooves that work in coordination.

Finally, referring to the far left and right ends of the device shown in FIG. 1, each screw 10 may be covered by a cap 9, 91 to prevent rust.

Summarizing, and as may be seen in FIGS. 1-2 and 4-7, the diverter valve assembly 100 includes an inlet port 11, a first outlet port 12, and a second outlet port 12, all disposed radially around the valve body 1. Seated within the valve body 1, the valve core 2 controls the direction of water flow through the diverter valve assembly 100. The valve core 2 is adjusted by an attached rotation knob 3. The valve body 1 has an internal chamber 14, which is fluidly connected with each of the inlet port 11, the first outlet port 12, and the second outlet port 13. The valve core 2 cooperates closely with the chamber 14. The valve core 2 includes a valve stem 21 extending outside of the valve body 1, and a center plug 22 contained within the valve body 1. The valve stem 21 is connected to the rotation knob 3, and the center plug 22 includes a partition 23 that connects to the elastic cup seal 231. That elastic cup seal 231 engages with one of the inlet port 11, the first outlet port 12, or the second outlet port 13. The valve core 2 includes an internal passage 24 that allows water to flow through it.

Thus, the diverter valve assembly 100 uses the elastic cup seal 231 in the valve core 2 to plug the valve body 1, thereby switching the water flow path. This avoids life cycle problems that occur when using a traditional valve assembly with an attached spring. Thus, the service life of the diverter valve assembly 100 of the invention will typically be longer than the service life of traditional valve assemblies that are subject to spring corrosion. Also, the water pressure from the water that impinges on the back of the structure that includes the elastic cup seal 231 will help to seal the diverter valve assembly 100.

The foregoing is considered as illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to as falling within the scope of the invention.

The invention claimed is:

1. A diverter valve assembly that selectively controls a flow of water supplied to the diverter valve assembly, comprising:

a valve body having a water inlet port, a first outlet port and a second outlet port, each of said ports disposed radially around the valve body, and an internal chamber in fluid communication with each of the water inlet port, the first outlet port, and the second outlet port;

a valve core rotatably positioned with the internal chamber of the valve body, the valve core configured to control the direction of water flow within the diverter valve assembly, the valve core including (i) a center plug having a partition and a passageway that allows water to flow into the center plug; (ii) a valve stem extending from an end of the valve core to a position outside of the internal chamber; and (iii) an elastic cup seal coupled to the partition of the center plug, wherein water that flows into the center plug through the passageway exerts pressure on the elastic cup seal; and a rotation knob coupled to the valve stem, the elastic cup seal configured to block water flow when fully engaged with any of the water inlet port, the first outlet port, and the second outlet port.

2. The diverter valve assembly of claim 1, wherein the elastic cup seal comprises a convex surface that protrudes outward from the central plug, wherein the convex surface defines an area that is larger than an opening for any of the water inlet port, the first outlet port, or the second outlet port.

3. The diverter valve assembly of claim 1, further comprising a holder coupled to a first side of the valve body, the holder configured to receive a hand-held sprayer.

4. The diverter valve assembly of claim 3, further comprising a positioning device coupled between the holder and the valve body.

5. The diverter valve assembly of claim 4, wherein the positioning device comprises:

a top mesh plate coupled to the holder; and a bottom mesh plate coupled to the first side of the valve body.

6. The diverter valve assembly of claim 5, wherein radial grooves on a surface of the top mesh plate and corresponding radial grooves on a surface of the bottom mesh plate are frictionally engaged.

7. The diverter valve assembly of claim 1, further comprising a positioner and an adjuster disposed between portions of the rotation knob and the valve body.

8. The diverter valve assembly of claim 7, wherein the adjuster is secured to the valve body by one or more screws.

9. The diverter valve assembly of claim 7, wherein the valve stem extends through a hole in each of the positioner and the adjuster.

10. The diverter valve assembly of claim 7, wherein hooked spurs extending from the positioner are engaged with corresponding holes on the adjuster, coupling the positioner and the adjuster together.

11. The diverter valve assembly of claim 7, wherein the rotation knob includes a spring plunger, and the positioner includes a plurality of positioning slots, the spring plunger configured to selectively engage with the plurality of positioning slots.

12. A shower assembly comprising:

a shower head;

a hand-held sprayer; and a diverter valve assembly, the diverter valve assembly comprising:

a valve body having a water inlet port, a first outlet port and a second outlet port disposed radially around the valve body, and an internal chamber connected with each of the water inlet port, the first outlet port and the second outlet port;

a valve core rotatably positioned with the internal chamber of the valve body, the valve core comprising a center plug disposed within the internal chamber, an elastic cup seal, and a valve stem disposed outside of the internal chamber, the valve core configured to control the direction of water flow within the diverter valve assembly, wherein the center plug includes a partition and a passageway that allows water to flow into the center plug, wherein the elastic cup seal is coupled to the partition of the center plug, wherein water that flows into the center plug through the passageway exerts pressure on the elastic cup seal; and a rotation knob coupled to the valve stem, the elastic cup seal configured to block water flow when fully engaged with any of the water inlet port, the first outlet port and the second outlet port.

13. The shower assembly of claim 12, wherein the elastic cup seal comprises a convex surface that protrudes outward from the central plug, wherein the convex surface has a larger surface area than a surface area of either the water inlet port, the first outlet port or the second outlet port.

14. The shower assembly of claim 12, further comprising:

a holder coupled to a first side of the valve body, the holder configure to receive the hand-held sprayer; and a positioning device coupled between the holder and the valve body.

15. The shower assembly of claim 14, wherein the positioning device comprises:

a top mesh plate coupled to the holder; and a bottom mesh plate coupled to the first side of the valve body, wherein radial grooves on a surface of the top mesh plate and corresponding radial grooves on a surface of the bottom mesh plate are frictionally engaged.

16. The shower assembly of claim 12, further comprising a positioner and an adjuster disposed between portions of the rotation knob and the valve body.

17. The shower assembly of claim 16, wherein the adjuster is secured to the valve body by one or more screws.

18. The shower assembly of claim 16, wherein the valve stem extends through a hole in each of the positioner and the adjuster.

19. The shower assembly of claim 16, wherein hooked spurs extending from the positioner are engaged with corresponding holes on the adjuster, coupling the positioner and the adjuster together.

20. The shower assembly of claim 16, wherein the rotation knob comprises a spring plunger and the positioner comprises a plurality of positioning slots, the spring plunger configured to selectively engage with the plurality of positioning slots.

* * * * *